US005163289A

United States Patent [19]

Bainbridge

[11] Patent Number: 5,163,289

[45] Date of Patent: Nov. 17, 1992

[54] AUTOMOTIVE EXHAUST SYSTEM

[75] Inventor: David W. Bainbridge, Littleton, Colo.

[73] Assignee: Manville Corporation, Denver, Colo.

[21] Appl. No.: 772,992

[22] Filed: Oct. 8, 1991

[51] Int. Cl.[5] ..... F01N 7/14

[52] U.S. Cl. ..... 60/274; 60/299; 138/149

[58] Field of Search ..... 60/272, 274, 299, 323; 138/149, 173

[56] References Cited

U.S. PATENT DOCUMENTS 3,233,699 2/1966 Plummer ..... 60/272
4,345,430 8/1982 Pallo et al. ..... 60/282
5,031,401 7/1991 Hinderks ..... 60/302
5,092,122 3/1992 Bainbridge ..... 60/272

*Primary Examiner*—Ira S. Lazarus
*Assistant Examiner*—L. Heyman
*Attorney, Agent, or Firm*—Cornelius P. Quinn

[57] ABSTRACT

An automotive exhaust system incorporating an insulated exhaust pipe. The insulation is selected so that it is very efficient at relatively low temperatures, thereby allowing the exhaust gases to reach the light-off temperature of the catalytic converter in a short time, and less efficient at high temperatures, thereby maintaining the temperature of the exhaust gases below the level at which aging of the catalytic converter increases.

13 Claims, 1 Drawing Sheet

AUTOMOTIVE EXHAUST SYSTEM

FIELD OF THE INVENTION

This invention relates to automotive exhaust systems. More particularly, it relates to the exhaust pipes used to deliver exhaust gases from an internal combustion engine to a catalytic converter.

BACKGROUND O THE INVENTION

Catalytic converters are conventionally included in the exhaust system of automotive vehicles to reduce the level of pollutants discharged to the air. While it is generally believed that the catalytic converters used today perform satisfactorily once their light-off temperature is reached, a pollution problem exists during the light-off period. For example, it has been determined that 80% of the pollutants exhausted to the atmosphere from an exhaust system which includes a catalytic converter are formed during the light-off period. As used herein, the light-off temperature is the temperature at which a catalytic converter catalyzes the reaction that takes place in the converter with the exhaust gases. The catalytic light-off period is the time required for the catalytic converter to reach its light-off temperature.

If the heat of exhaust gases traveling from the engine to the catalytic converter can be retained for a longer period of time than in conventional exhaust systems, the time required for the light-off temperature to be reached will be reduced. This would then reduce the duration of high pollution, and in turn reduce the amount of pollutants released to the atmosphere.

Attempts have been made in the past to develop insulated exhaust systems. Double exhaust pipes have been suggested, comprising spaced inner and outer pipes. Although this reduces the amount of heat loss, it is not enough to appreciably retain heat at the level required for optimum catalytic converter operation.

Another suggestion is found in U.S. Pat. No. 4,345,430, issued to Pallo et al. In that patent a double pipe system comprised of inner and outer corrugated metal tubes is disclosed. In addition, the use of insulation between the inner and outer tubes is suggested. There is no appreciation in the Pallo et al patent or in other exhaust pipe designs, however, of the further problem of increased aging of the catalytic converter. Each catalytic converter is designed to most efficiently operate not only above a certain minimum temperature, but also below a certain maximum temperature. When operating temperatures exceed this maximum temperature the catalytic converter is subject to accelerated or increased aging, which in time reduces the effective life of the catalytic converter.

While the use of an insulated exhaust pipe to retain the heat of exhaust gases reduces the light-off period and is thus beneficial in reducing the amount of pollutants discharged to the atmosphere, it also tends to reduce the life of the catalytic converter by delivering gases at a temperature greater than the maximum desired operating temperature. It would therefore seem that the two goals of achieving a short light-off period and a long operating life for a catalytic converter are mutually exclusive and cannot be met in any particular automotive exhaust system.

BRIEF SUMMARY OF THE INVENTION

In accordance with the invention, an insulated exhaust pipe is used in the exhaust system of a vehicle powered by an internal combustion engine to connect the engine to the catalytic converter. By utilizing insulation which is specially suited to perform at certain efficiencies at certain temperatures, the exhaust gases delivered to the catalytic converter very quickly develop temperatures which reach the light-off temperature of the catalytic converter. Further, the temperature of the gases continues to increase up to a point approaching the maximum desired operating temperature above which aging of the catalytic converter is accelerated. This is brought about by employing insulation which provides the insulated exhaust pipe with a coefficient of thermal conductivity of substantially less than 1.0 at the light-off temperature and approximately 1.0 at temperatures approaching the maximum desired operating temperature. In a preferred embodiment pertinent to catalytic converters employed in automobiles, the coefficient of thermal conductivity is in the range of 0.55 to 0.7 when the light-off temperature is in the range of 600° F. to 800° F. and is in the range of 0.9 to 1.1 when the maximum desired operating temperature is approximately 1200° F.

The exhaust pipe preferably is in the form of concentrically arranged tubes, with thermal insulation filling the annular space between the tubes.

These and other features and aspects of the invention, as well as the benefits thereof, will be clear from the more detailed description of the preferred embodiment which follows.

BRIEF DESCRIPTION OF THE DRAWINGS

FIG. is a schematic representation of an automotive exhaust system incorporating the insulated exhaust pipe of the invention.

DETAILED DESCRIPTION OF THE PREFERRED EMBODIMENT

Figure 1:
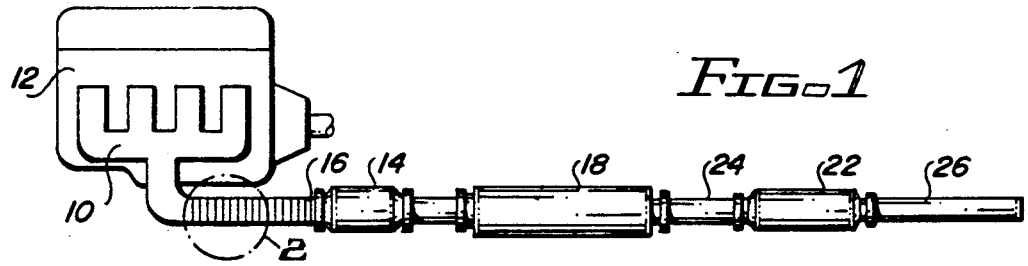

Referring to FIG. 1, the exhaust manifold 10 of an automotive engine 12 is connected to a catalytic converter 14 by an exhaust pipe 16 constructed in accordance with the invention. A typical exhaust system may include a muffler 18 connected to the catalytic converter 14 by exhaust pipe 20 and a resonator 22 connected to the muffler by exhaust pipe 24. A tailpipe 26 would normally extend from the resonator. Although the exhaust pipe sections 20 and 24 may be insulated if desired, the invention is concerned primarily with the exhaust pipe 16, since it is this pipe that must insulate the exhaust gases traveling from the engine to the catalytic converter.

Figure 3:
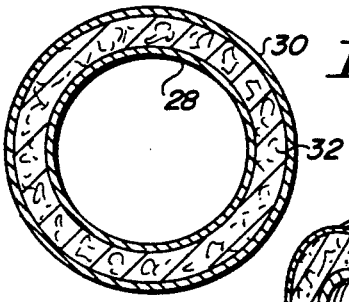
FIG. 3 is an enlarged transverse sectional view of the insulated pipe taken along line 3—3 of FIG. 2.
Figure 2:
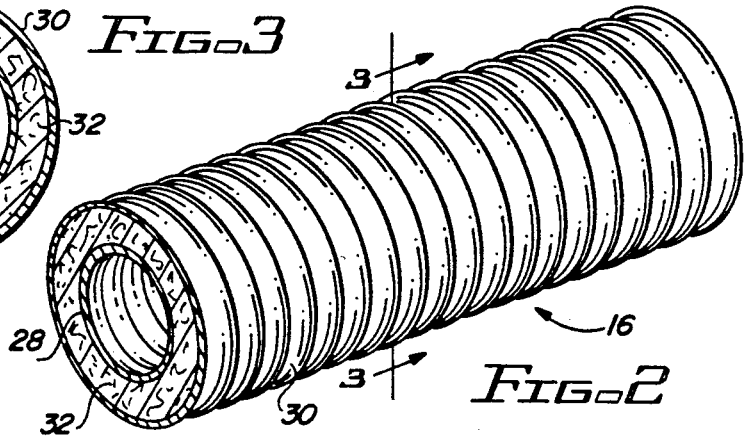
FIG. 2 is an enlarged pictorial view of the portion of the insulated exhaust pipe enclosed within the oval 2.

As shown in FIGS. 2 and 3, the insulated exhaust pipe 16 comprises an inner tube 28 spaced from and concentrically arranged with respect to a larger outer tube 30. The annular space created by this arrangement is filled with insulation 32.

The insulation may be any high temperature fibrous insulation or injectable insulation which can be thermally tuned, or in other words, selected according to the variables that determine its coefficient of thermal conductivity at particular temperatures. Thus in the present invention, it is desirable to employ insulation which is highly efficient at temperatures at least as great as the light-off temperature. Such insulation will allow relatively little loss of heat from the exhaust gases within this temperature range and will result in the light-off temperature being reached in a minimum period of time. The light-off temperature of most automotive catalytic converters is in the range of 600° F. to 800° F.

As previously mentioned, it is desirable to retain exhaust gas heat up to the temperature at which aging of the catalytic converter is accelerated, but to prevent the catalytic converter from being exposed to this high temperature. According to the invention, this requirement translates to an insulation whose coefficient of thermal conductivity is 1.0 at temperatures approaching the point at which increased aging occurs. Insulation of such a coefficient is less efficient than insulation having a low coefficient of thermal conductivity but is capable of maintaining the heat within the insulated exhaust pipe at a constant temperature, resulting in the catalytic converter being exposed to gases of that same constant temperature.

An example of insulation suitable for use in the exhaust pipe of the invention is a blanket produced from refractory fibers. Such fibers are capable of withstanding the high temperatures of exhaust gases from automotive engines, and in blanket form they provide for ease of handling prior to and during the pipe fabrication process. Various grades of refractory fiber blankets are commercially available, depending on the temperatures to which the insulation will be exposed in operation. Cerawool Blanket for service up to 1600° F., Cerablanket for service up to 2400° F., and Cerachem and Cerachrome Blankets for service up to 2600° F. are all available from Manville Sales Corporation and will function well in the insulated pipe of the invention. Refractory fiber blankets such as these are formed from very pure alumina, silica and other refractory oxides, a typical general formulation being 40% to by weight of silica, 40% to 60% by weight of alumina and 0 to 10% by weight of oxides such as chromia, iron oxide, calcia, magnesia, soda, potassia, titania, boria or mixtures of these oxides. The insulation is able to retain a soft fibrous structure at elevated temperatures and can be needled together, if necessary, for higher mechanical strength. In addition to having low thermal conductivity, it has low shrinkage and also provides good sound absorption. Such blankets are available in densities from 4 pounds per cubic foot (pcf) to 16 pcf, and can readily be wrapped around a pipe. Fibrous insulation material such as fiber glass or mineral wool could not stand up to the high temperatures of the gases coming from the manifold of modern vehicles.

Figure 4:
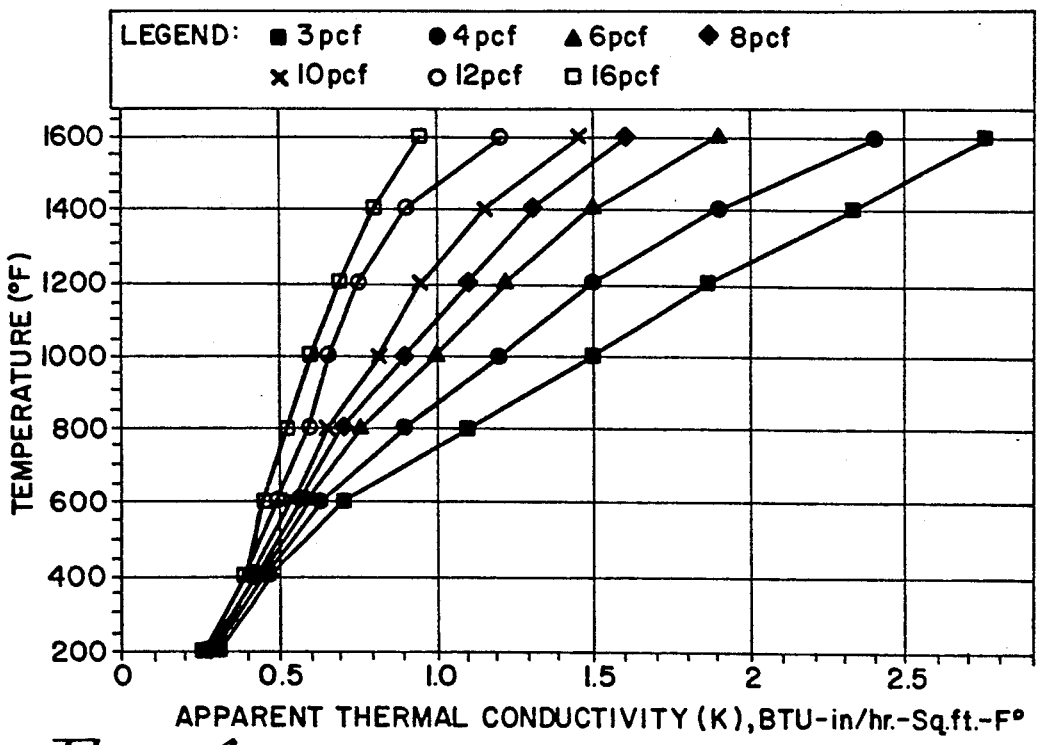
FIG. 4 is a graph showing the apparent thermal conductivity of one type of insulation employed in the exhaust system at various temperatures.

Referring to FIG. 4, the relationship of thermal conductivity (K) to temperature and density for a particular type of refractory fiber blanket is illustrated. In this case the insulation material is Cerablanket refractory fiber, referred to above. Looking at the temperature of 1200° F., which is the temperature at which most catalytic converters used on automobiles begin to suffer from increased aging, it can be seen that the blanket densities that have a K value of about 1.0 at this temperature level are those between the densities of 8 pcf and 10 pcf. Although it is preferred to maintain the K value at no more than 1.0, a K value slightly greater than that, such as 1.1, is tolerable. The K value of these blankets at the lightoff temperature of 600° F. to 800° F. is approximately 0.55 to 0.7, which is sufficiently low to prevent significant escape of heat from the exhaust pipe between the engine manifold and the catalytic converter. Obviously, other blanket densities may be appropriate instead if the type of refractory or other fiber is changed, as long as the ability of the material to insulate at the light-off temperature and to hold the heat constant at temperatures approaching the maximum desirable operating temperature is maintained. As mentioned previously, other types of insulating materials, including combinations of refractory fibers and insulating powders, such as fumed silica or flue ash, may be employed instead of refractory fibers, provided that the variables of the material can be selected to provide the desired result. By adding relatively dense insulating powders to refractory fibers the density of the insulating material is increased, thereby improving the K value of the insulation.

The variables of refractory fiber insulation, and for all types of fibrous insulation, are the density and thickness of the blanket or layer, the fiber diameter and shot content of the material and the temperature to which the insulation is exposed. By selecting a particular type of insulation at a particular blanket thickness, the variables of fiber diameter, shot content and thickness are fixed because they are embodied in the insulation. Tests can then be run using various densities of the selected material at various temperatures to determine whether a specific insulation will provide satisfactory performance at the critical ranges of temperature for the catalytic converter in question. For nonfibrous insulation, the variables of fiber diameter and shot content are not present, leaving only different densities of the material to be varied at different temperatures in order to determine the correct density range to use for a particular type of insulation.

Referring back to FIGS. 2 and 3, the tubes 28 and 30 must be able to withstand the heat generated by the exhaust gases, be thin enough to reduce the thermal mass of the insulated pipe, and be able to withstand the stresses caused by the fatigue encountered during use. They should also be non-corrosive. Preferably, the tubes are comprised of stainless steel which is corrugated in order to allow the pipe to be bent and to give the pipe the flexibility needed for installation on various types of vehicles and at various angles. The corrugated tubes may be formed by butt welding a strip containing embossed corrugations or by helically winding a strip and then folding and crushing the overlapped portions to form a continuous sealed tube, as described in more detail in U.S. Pat. No. 3,753,363 to Trihey. It is preferred that the inner tube be formed by the butt welding method in order to better ensure a gas tight seal.

For a self-supporting exhaust pipe, the wall thickness of the inner tube should preferably be in the range of about 0.006 inch to 0.016 inch, while the wall thickness of the outer tube should preferably be in the range of 0.009 to 0.035 inch. If the tube thicknesses are less than these minimum amounts they may not have enough strength to resist fatigue and may eventually break. If the thicknesses are greater than these maximum amounts it will unnecessarily add to the weight of the pipe. Further, if the tubes are formed by the helical winding method and the wall thicknesses of the tubes are greater than the maximum amounts of the wall thickness ranges, they may not have sufficient elongation or malleability to enable the seam between adjacent corrugated strips to be formed. It will be understood that in this structure the inner tube functions merely as a conduit for the exhaust gases while the outer tube is the structural member of the composite.

Because this very thin structure substantially reduces the weight of the insulated pipe, the resulting low thermal mass reduces the amount of heat loss and thus reduces the time for the catalytic converter to reach its light-off temperature. The tubes are spaced from each other over their entire length, thus avoiding metal-to-metal contact. This can be important because it eliminates areas of greater heat loss and also acts to isolate exhaust noise. Although the details of means for attaching the ends of the exhaust pipe to the engine manifold or the catalytic converter are not shown, it will be understood that any suitable attachment arrangement that does not cause the inner and outer tubes to touch and does not destroy the integrity of the pipe may be employed. The design and installation of such attachment means are therefore well within the ability of the skilled mechanic.

To compare the performance of commercially available exhaust pipes and insulated pipe formed from the insulation used in obtaining the data shown in FIG. 4, each type of exhaust pipe was used to connect a catalytic converter to the exhaust manifold of the engine of an automobile running at 20 miles per hour. When connected to the engine manifold by the standard type of exhaust pipe consisting merely of a single metal pipe, the catalytic converter required 110 seconds to reach light-off. The air gap type of exhaust pipe, consisting of a double pipe with an air gap between pipes, required 100 seconds. The insulated pipe of the invention required only 70 seconds to reach light-off. This is an improvement of great magnitude, resulting in the prevention of considerable amounts of pollutants being discharged into the air. Furthermore, such a pipe can be expected to extend the life of the catalytic converter because it does not allow gases above the maximum desirable operating temperature to be introduced to the catalytic converter. Furthermore, the insulated pipe does not allow the catalytic converter to cool below the light-off temperature, thereby limiting the number of complete cycles of operation to which the catalytic converter is subjected.

In addition, tests conducted with the same three exhaust pipe designs with the engine running at 25 miles per hour showed that with the standard exhaust pipe in use the temperature of the catalytic converter was in the range of about 875° F. to 950° F., with the air gap type of exhaust pipe the temperature was in the range of about 980° F. to 1000° F., and with the exhaust pipe of the invention the temperature was in the range of about 1000° F. to 1080° F. The catalytic converter thus operated at a more efficient temperature when the exhaust pipe of the present invention was utilized, still without danger of being exposed to temperatures above those that would cause increased aging.

The insulated pipe structure described is intended to function as the exhaust pipe, fully replacing the conventional standard type of thick-walled pipe. Instead of being limited to such a self-supporting insulated exhaust pipe, the present invention also contemplates the features of the invention being incorporated in an insulated composite tube designed to be slid or trained over an existing standard exhaust pipe section. The inner tube of such a composite tube will be only slightly larger in diameter than the outside diameter of the standard exhaust pipe over which it is to fit.

As in the previous embodiment, the preferred material of such a slip-on exhaust pipe is stainless steel. In this case, however, it would have a thickness only in the range of 0.002 inch to 0.004 inch. This is considerably thinner than the metal of a corrugated tube intended to function as a self-supporting exhaust pipe, and is not strong enough by itself to resist fatigue. Such extremely thin material, however, gives the corrugated tubes the flexibility needed to be moved over curved or angled portions of an exhaust pipe. If material thinner than about 0.002 inch were used the resulting tube would not have the necessary structural integrity, while material thicker than 0.004 inch would not have the necessary flexibility.

In use, a length of the slip-on insulated tube is pushed onto an existing standard exhaust pipe and moved along the entire extent of the pipe, at least up to the point at which a flange or other type of pipe mounting means is intended to be located. When the tube encounters a bend or curve in the exhaust pipe, the extreme flexibility of the insulated tube enables it to conform to the curvature of the pipe. It is understood that the space between the inner and outer tubes would be in accordance with the required thickness of insulation determined as discussed above.

It should now be appreciated that the present invention greatly improves the performance of automotive catalytic converters and also extends their life. Further, the new exhaust pipe is relatively inexpensive and simple to install. In addition, the use of insulation as described also provides sound absorption benefits unattainable with standard exhaust pipe or with the uninsulated double pipe design. It will be understood, however, that the exhaust pipe of the invention is not limited to all the specific details described above, and that changes which do not affect the overall basic function and concept of the invention may be made by those skilled in the art without departing from the spirit and scope of the invention, as defined in the claims.

What is claimed is:

1. In the exhaust system of a vehicle powered by an internal combustion engine, which includes a catalytic converter designed to operate at temperatures above a predetermined minimum light-off temperature and preferably below a maximum desired operating temperature, the improvement comprising:

an insulated exhaust pipe connecting the engine and the catalytic converter;

the insulated exhaust having a coefficient of thermal conductivity which is in the range of 0.55 to 0.7 at the light-off temperature and is approximately 1.0 at temperatures approaching the maximum desired operating temperature.

2. The exhaust system improvement of claim 1, wherein the light-off temperature is in the range of 600° F. to 800° F.

3. The exhaust system improvement of claim 1, wherein the coefficient of thermal conductivity is in the range of 0.9 to 1.1 at the maximum desired operating temperature.

4. The exhaust system improvement of claim 1, wherein the maximum desired operating temperature is in the range of 1000° F. to 1100° F.

5. The exhaust system improvement of claim 1, wherein the insulated exhaust pipe comprises an inner tube of relatively small diameter and an outer tube of relatively large diameter, the tubes being concentrically arranged to form an annulus therebetween, and thermal insulation material filling the annulus surrounding the inner tube.

6. The exhaust system improvement of claim 5, wherein the inner and outer tubes include corrugations.

7. The exhaust system improvement of claim 6, wherein the inner and outer tubes are comprised of stainless steel, the inner tube having a wall thickness in the range of 0.006 inch to 0.016 inch and the outer tube having a wall thickness in the range of 0.009 inch to 0.035 inch.

8. The exhaust system improvement of claim 5, wherein the thermal insulation material is comprised of refractory fibers.

9. The exhaust system improvement of claim 8, wherein the refractory fiber insulation has a density in the range of 8 to 10 pounds per cubic foot.

10. In a method of delivering exhaust gases to a catalytic converter in the exhaust system of a vehicle powered by an internal combustion engine, wherein the operation of the catalytic converter is at temperatures above a predetermined minimum light-off temperature and preferably below a maximum desired operating temperature, the steps comprising:

providing an insulated exhaust pipe having a coefficient of thermal conductivity which is in the range of 0.6 to 0.8 at the light-off temperature of the catalytic converter and is approximately 1.0 at temperatures approaching the maximum desired operating temperature; and delivering the exhaust gases to the catalytic converter through the insulated exhaust pipe.

11. The method of claim 10, wherein and the coefficient of thermal conductivity is in the range of 0.9 to 1.1 at the maximum desired operating temperature.

12. The method of claim 10, wherein the light-off temperature is in the range of 600° F. to 800° F., and the maximum desired operating temperature is in the range of 1000° F. to 1100° F.

13. The method of claim 10, wherein the thermal insulation material is comprised of refractory fibers having a density in the range of 8 to 10 pounds per cubic foot.

* * * * *